US005724689A

United States Patent [19]

Milligan et al.

[11] Patent Number: 5,724,689

[45] Date of Patent: Mar. 10, 1998

[54] METHOD AND APPARATUS FOR TREATING KNITTED FABRIC

[75] Inventors: William D. Milligan, Matthews; Fritz Witt, Charlotte; Hong Peng, Greensboro, all of N.C.

[73] Assignee: Tubular Textile LLC, Lexington, N.C.

[21] Appl. No.: 728,481

[22] Filed: Oct. 11, 1996

Related U.S. Application Data

[60] Provisional application No. 60/005,283, Oct. 12, 1995.

[51] Int. Cl.[6] ..... D06B 3/10

[52] U.S. Cl. ..... 8/149.3; 68/5 D

[58] Field of Search ..... 8/149.1, 149.3; 68/5 C, 5 D, 5 E; 26/51, 81

[56] References Cited

U.S. PATENT DOCUMENTS

| | | | |
|---|---|---|---|
| 3,318,114 | 5/1967 | Schneider . | |
| 3,447,346 | 6/1969 | Norton . | |
| 4,070,877 | 1/1978 | Fleissner | 68/5 D |
| 4,164,051 | 8/1979 | Sando et al. | 8/149.1 |
| 4,183,151 | 1/1980 | Frezza | 68/5 D X |
| 4,184,846 | 1/1980 | Diggle, Jr. | 8/149.1 |
| 4,236,391 | 12/1980 | Stobi | 68/5 D |
| 4,236,392 | 12/1980 | Sando et al. | 68/5 E |
| 4,259,853 | 4/1981 | Fleissner | 68/5 D |
| 4,305,185 | 12/1981 | Frezza | 26/75 |
| 4,454,171 | 6/1984 | Diggle, Jr. et al. | 8/149.1 X |
| 4,528,708 | 7/1985 | Sando et al. | 8/149.1 |
| 4,984,439 | 1/1991 | Smejda | 68/5 C |
| 5,010,612 | 4/1991 | Jensen et al. | 8/149.1 |
| 5,205,008 | 4/1993 | Kohnen et al. | 8/149.1 |
| 5,321,864 | 6/1994 | Holderer | 8/149.1 |
| 5,400,621 | 3/1995 | Smejda | 68/5 C |
| 5,408,715 | 4/1995 | Keller et al. | 8/149.1 |
| 5,413,636 | 5/1995 | Smejda | 8/149.1 X |
| 5,497,524 | 3/1996 | Fleissner | 8/149.1 |

FOREIGN PATENT DOCUMENTS

| | | | |
|---|---|---|---|
| 2656425 | 6/1978 | Germany | 68/5 D |
| 1675447 | 9/1991 | U.S.S.R. | 68/5 D |

*Primary Examiner*—Philip R. Coe

*Attorney, Agent, or Firm*—Schweitzer Cornman Gross & Bondell LLP

[57] ABSTRACT

A method and apparatus for finish processing of knitted fabric. Fabric, supplied in substantially dry condition and in generally flat form, is directed through an open bottom, vertically oriented steam chamber, constantly supplied with fully saturated steam at atmospheric pressure. Upon exiting the steam chamber, the knitted fabric is laterally distended to a predetermined width, and then subjected to finish processing, such as calendering or compacting. A sensing device in the steam chamber maintains a steam-air interface slightly above the open bottom of the chamber. More effective moisturizing of the fabric is accomplished, enabling the steaming operation to be performed prior to the spreading operation, without compromising the finish processing operations. Improved performance is realized, along with extraordinary savings in operating costs.

11 Claims, 2 Drawing Sheets

METHOD AND APPARATUS FOR TREATING KNITTED FABRIC

This application claims priority of provisional application Ser. No. 60/005,283, filed Oct. 12, 1995 now abandoned.

BACKGROUND AND SUMMARY OF THE INVENTION

The present invention is directed to the finishing treatment of knitted fabrics, both tubular and open width. In the preliminary processing of knitted fabrics, the fabrics tend to become significantly elongated and correspondingly narrowed in width, by reason of lengthwise tensions applied to the material during processing. Conventionally, the finishing treatment of such fabrics has involved spreading of the fabric to a predetermined width, steaming the fabric while it is held at such width, and immediately thereafter subjecting the fabric to a finish processing operation, such as calendering between pressure rollers or compacting the fabric in a lengthwise direction to remove or minimize any residual lengthwise shrinkage tendencies.

At the stage of finishing treatment, the fabric is in a substantially dry condition, typically at or near equilibrium with ambient conditions. In order for the finish treatment operations to be properly carried out, the fibers of the fabric are lubricated by the addition of steam. In a typical process for the treatment of tubular knitted fabric, for example, the fabric is directed over an internal spreader frame, which typically includes entry and exit portions, with external edge drive means located at an intermediate point, driving the entry portion of the spreader frame at a somewhat higher rate of speed than the exit portion to accommodate the tendency of the fabric to decrease in length as its width is enlarged. Conventionally, arrangements are providing for directing jets of steam through the fabric, as it passes over the exit portion of the spreader frame and immediately before the fabric enters the finish processing, such as calendering or compacting. An example of such a conventional arrangement is shown in the Frezza U.S. Pat. No. 4,305,185.

Although the arrangement described above is in extensive use on a worldwide basis, it has certain shortcomings, which we have been able to obviate by the present invention. Among the shortcomings is the requirement to inject substantial amounts of steam toward the fabric, usually from above and below a horizontally moving flat fabric web, in an effort to adequately lubricate the fibers of the fabric. In this procedure, substantial quantities of excess steam are discharged into the ambient, requiring the installation of a substantial exhaust hood and exhaust fan in order to maintain an appropriate working environment. Significant expense is involved in such an arrangement, not only in the loss of heat energy from the excess steam, but also (and perhaps more importantly) in the simultaneous exhausting of plant air, which may have been heated or air conditioned.

Preferably, the application of steam should be made at or near the upstream end of the spreading apparatus, so that the fabric has the benefit of the lubricating heat and moisture during the initial phases of lateral distention of the fabric on the entry portion of the spreader. With conventional steaming equipment, however, it was observed that, if the steam were applied at the entry end of the spreader, too much of the moisture had evaporated by the time the fabric reached the finish processor, at the discharge end of the spreader. Providing steaming devices at both the entry and exit portions of the spreader was not a satisfactory answer, because of the excessive amounts of steam and energy required.

In accordance with the present invention, a novel method and apparatus is provided for the finishing treatment of knitted fabric, wherein the fabric is thoroughly steamed immediately adjacent the entry end of the spreader, with the steaming operation being effective to impart moisture to the fabric in amounts and at temperature levels that result in the fabric being able to traverse the entire length of the spreader and to enter the finish processor with adequate heat and moisture for the desired fiber lubrication. Effective steaming of the incoming, substantially dry knitted fabric is achieved by directing the fabric through a vertically oriented steaming chamber, which is open only at the bottom, and through which the fabric travels first in an upwardly direction and then downwardly, and thence directly to the entry end of the spreader.

In accordance with the invention, steam is supplied to the interior of the steam chamber in a condition of 100% saturation at atmospheric pressure. The steam, being lighter than air, displaces all of the air in the upper portion of the chamber, so that the fabric, in its travel through the vertical steam chamber, is exposed for a period of time to an atmosphere made up substantially exclusively of saturated steam, substantially free of air. Because of this substantially "pure" atmosphere of saturated steam, the fabric can be heated and fully moisturized in a very short period of time so that, even with relatively high rates of operating speed, a steam chamber of modest vertical heights is sufficient to effectively process the incoming fabric and impart sufficient moisture thereto to both facilitate the spreading operation at the entry end of the spreader and to effectively complete the processing in the finish processing stage at the exit end of the spreader.

Pursuant to the invention, the delivery of steam to the vertical steam chamber is controlled to maintain a steam-air boundary layer at a level slightly above the bottom extremity of the chamber. This allows the processing to be carried out without the release of large amounts of excess steam, as is required by current practices. Thus, the process of the invention can be carried out with great economic advantage over conventional practices.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
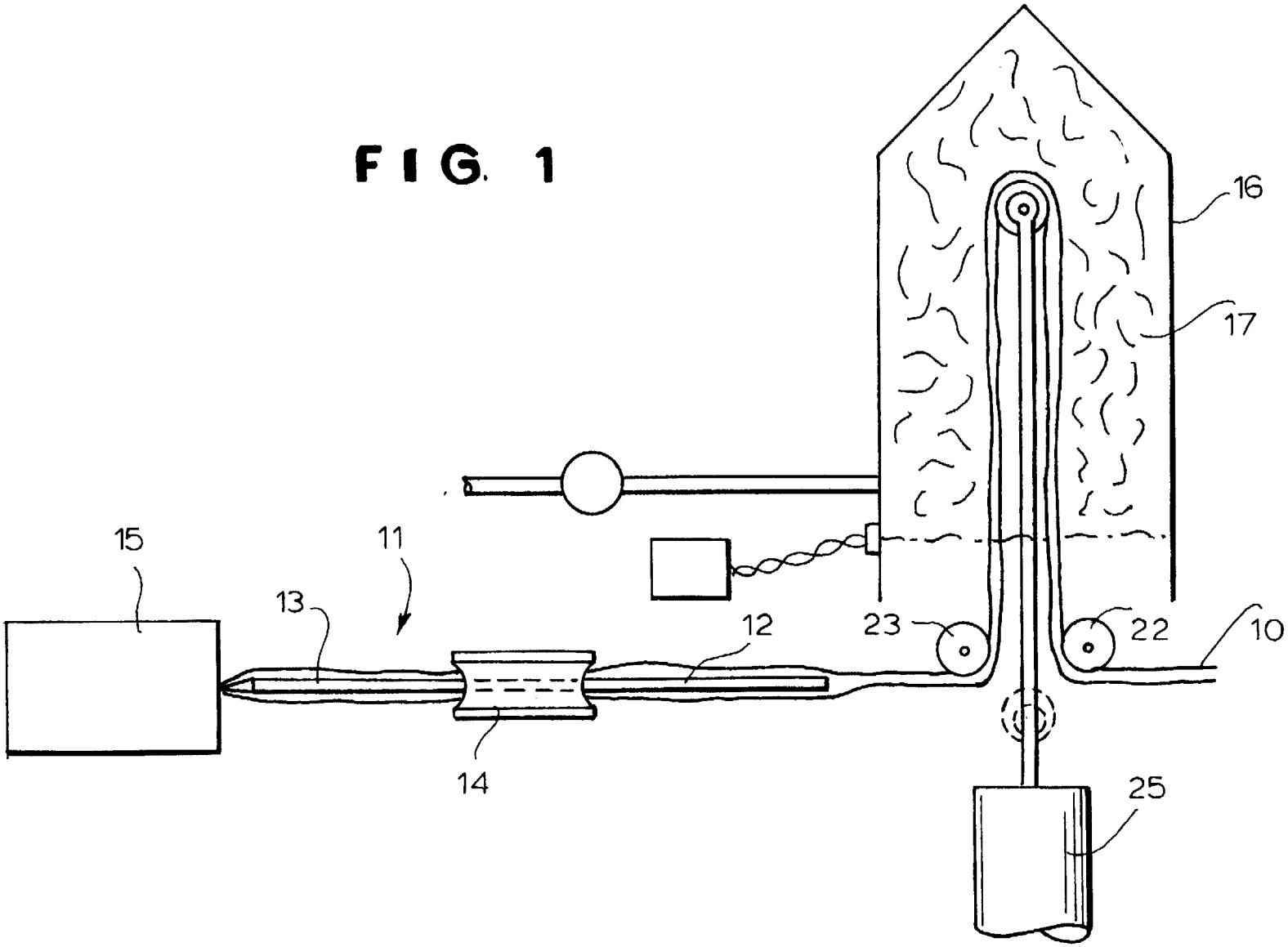
FIG. 1 is a schematic illustration of a processing line according to the invention for effecting the finishing treatment of tubular knitted fabric.

Referring now to the drawings, the reference numeral 10 indicates a pre-processed tubular knitted fabric being supplied for finishing operations. Primary finishing operations involve spreading, which is carried out on a suitable spreader frame generally indicated by the reference numeral 11 in FIG. 1. A typical spreader apparatus includes an entry portion 12, an exit portion 13 and edge drive roll means 14 positioned intermediate the entry and exit portions. In accordance with well known practices, the spreader frame may include separate internal belts on the entry and exit portions, which are driven at slightly different speeds by opposed edge drive rolls 14, which support and position the spreader frame and drive its belts through intervening walls of fabric. Conventionally, the exit end portion 13 of the spreader frame is provided with means (not shown in the present illustration) for steaming the fabric while it is still on the exit portion of the spreader frame and immediately before the fabric is discharged into a finishing processor 15. The finishing processor may be a pair of calender rolls, for example, as shown in the before mentioned Frezza U.S. Pat. No. 4,305,185, or the finish processor 15 may comprise mechanical compressive shrinkage apparatus, such as is shown in the Milligan et al. U.S. Pat. No. 5,016,329.

The incoming, pre-processed fabric 10 typically is supplied in generally flat form but at a width substantially less than the desired finished width. The spreader frame 11 is arranged to distend the fabric laterally while advancing it forwardly such that, at the exit end 13 of the spreader frame, the fabric is set at a predetermined, desired width for discharge into the finish processor 15. Typically, the fabric, under lateral tension as it passes over the spreader frame, narrows slightly as it enters the finish processing stage 15, and the setting of the spreader frame is thus set to sufficiently overspread the fabric to assure that the desired final width is realized at the end of the processing operations.

In accordance with the present invention, significant improvements in the finish processing of the fabric are realized by, immediately prior to spreading of the fabric on the spreader frame 11, exposing the fabric to fully saturated steam at atmospheric pressure, in the substantial absence of air, so that the fabric becomes thoroughly heated and moisturized. This is accomplished by directing the fabric upwardly into a confined steam chamber 16, and maintaining the confined chamber filled with substantially 100% saturated steam 17. In the illustrated form of the invention, the steam chamber 16 is a vertically oriented closed chamber, typically formed of a sheet metal liner 18 surrounded externally by a thick layer 19 of thermal insulation. The chamber 16 is completely closed, except for an opening 20 at its bottom and is formed with steeply slanted (e.g. 45°) upper wall panels 21.

Directly below the bottom opening 20 of the chamber 16 are entry and exit side guide rollers 22, 23. The incoming pre-processed fabric 10 passes around the entry side guide roller 22 and is directed generally vertically upward into the steam chamber 16, around an upper guide roller 24 and thence directly downward, exiting through the bottom opening 20 of the steam chamber and passing around the exit side guide roller 23, which is positioned immediately upstream of the entry portion 12 of the fabric spreader.

Figure 2:
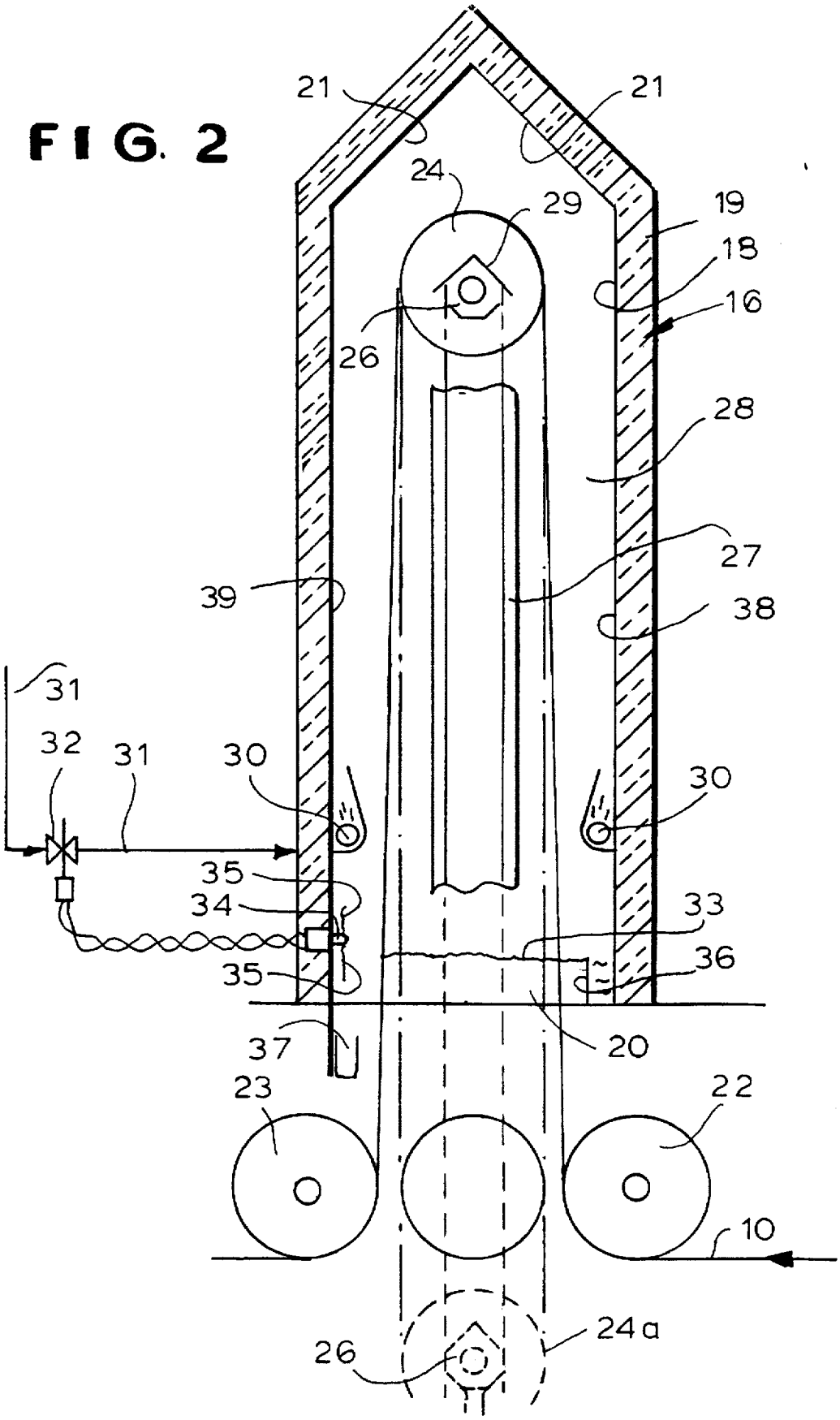
FIG. 2 is an enlarged cross sectional view, showing details of a steam processing chamber according to the invention, as incorporated in the processing line of FIG. 1.

To advantage, the upper guide roller 24 is mounted for vertical movement from an upper limit position, shown in full lines in FIG. 2, to a lower limit position, shown in broken lines at **24*a* in FIG. 2. A pair of suitable fluid actuators 25** or other positioning mechanisms are provided for this purpose.

In a preferred form of the invention, the upper guide roller 24 is mounted at each end in movable bearings 26, which are slidably guided in channels 27 mounted on opposite side walls 28 of the steam chamber. Thus, as the actuators 25 are extended, the bearings 26 and the upper guide roller 24 are supported and guided laterally by the channel 27. At the uppermost position of the roller 24, the bearings 26, which are formed with tapered upper surfaces, are received in a seat 29 of inverted V-shaped configuration to lock the bearings rigidly in position.

The retractability of the upper guide roller 24 is particularly desirable for initial threading of the processing line with a new length of fabric. Initially, the guide roller 24 is retracted to its lowermost position, indicated in FIG. 2, in which it lies below a plane defined by the bottom surfaces of the entry and exit side guide rollers 22, 23. Thus, in the initial threading operation, the pre-processed fabric 10 can be led horizontally underneath the guide roller 22, over the top of the guide roller 24 in its retracted position, and underneath the exit side guide roller 23. Thereafter, the actuator 25 is extended, elevating the guide roller 24 to its upper position within the steam chamber.

Within the steam chamber, there are sparger pipes 30 connected to a steam source through an inlet line 31 and control valve 32. In accordance with the invention, the inlet line 31 is connected to a source of saturated steam. Desirably, the steam is maintained at a condition of 100% saturation, substantially at atmospheric pressure and substantially at 212° F. When the valve 32 is opened, the saturated steam flows into the interior of the steam chamber 16 and substantially completely fills the chamber, which preferably is not divided or baffled, so that the steam may flow freely within the chamber. The saturated steam, being lighter than air, displaces air from the upper portion of the chamber. As the chamber fills, a steam-air interface, indicated at 33 in FIG. 2, approaches a point near the open bottom 20 of the chamber. Desirably, the steam-air interface 33 is maintained at a level just slightly above the bottom opening 20, so that steam does not escape from the bottom of the housing. At the same time, saturated, air-free steam occupies most of the volume of the chamber.

Automatic control of the level of the steam-air interface is enabled by providing a thermocouple element 34 in the lower portion of the steam chamber, projecting into the internal environment. The thermocouple element 34, provided with capillary feelers 35, normally detects the interface 33 by reason of the temperature differential on opposite sides thereof, and controls the valve 32 accordingly.

Substantially dry knitted fabric, passing through an air-free environment of saturated steam, can absorb heat and moisture at an extremely rapid rate. For example, a double layer of tubular knitted fabric, passing through such an atmosphere, will absorb adequate heat and moisture in less than 1.5 seconds. Under such conditions, fabric being processed at, for example, 100 yards per minute will be properly processed in the course of travel of about seven feet or less, so that the "working" portions of the steam chamber 16 can be less than four feet in height.

Reference herein to "substantially dry" knitted fabric does not refer to fabric that is in a bone-dry condition, or which has been specifically dried in preparation for the finishing operations. Rather, the term refers generally to fabric which carries a moisture content more or less consistent with ambient conditions in the plant and in any event less than the levels of moisture required for satisfactory finish processing.

In the finish processing of tubular or open width knitted fabric, it is important to prevent any condensate from dropping on to the fabric. To this end, the steam chamber 16 is heavily insulated to minimize condensate formation in the first instance. Nonetheless, inasmuch as some condensate inevitably will form, the upper walls 21 of the chamber are set at such an angle as to cause the condensate to flow along the surfaces thereof to the surfaces of the side walls. Adjacent the bottom of the chamber, the chamber is provided with condensate gutters 36, 37 arranged to receive all condensate coming down the entry side and exit side side walls 38, 39 and to drain any such condensate off to the side and safely away from the fabric being processed. Similar condensate gutters (not specifically illustrated) are provided in connection with the side walls 28.

It is understood of course that, in the processing of tubular knitted fabric, the steam is required to penetrate two layers of fabric. In the processing of open width fabric, on the other hand, only a single layer of fabric has to be penetrated, and contact times with the saturated steam may be correspondingly less.

It is contemplated that the upper guide roll 24 may be adjustably positioned vertically within the steam chamber 16. Thus, for processing of lightweight and/or narrow fabrics, for example, where less time may be required to achieve desired steam penetration contact time of the fabric with the steam may be reduced, if desired, by lowering the upper guide roll 24 to an intermediate position within the steam chamber.

Truly extraordinary benefits are realized through the practice of the invention, both in terms of superior processing results, and also in terms of significant reduction in processing costs. The processing of the fabric is significantly improved in that it becomes possible, in an economically feasible procedure, for the knitted fabric to be steamed prior to its initial entry on to the spreading apparatus. Because the fabric is effectively lubricated and supple when it enters the spreader, the desired lateral distention of the fabric is accomplished more easily, and the entry portion of the spreader apparatus is much more effective than with conventional procedures. More significantly, perhaps, because the fabric more easily accepts the lateral distention throughout its entire passage over the spreader frame, it has been found that the required "overspreading" of the fabric, in order to achieve a desired width of finish processed fabric exiting from the finish processor 15, can be reduced by as much as an inch. It thus becomes much easier to control the final width of the fabric, and the fabric is less likely to become marked or distorted during the spreading process.

In addition to the important processing advantages realized in the practice of the invention, as described above truly extraordinary monetary savings can be realized in the practice of the new process. Thus, in a typical conventional finish processing line running at the rate of about 7200 hours per year and with a steam cost calculated at about $5.00 per 1000 lb. of steam, annual savings of around $4000.00 per year can be expected in steam costs alone, because of the greater efficiencies in steam usage enabled by the system of the invention. Of possibly even greater importance, moreover, is the savings in the cost of make-up air. Thus, in the course of exhausting excess steam through a steam hood, as is presently required, as much as 10,000 cfm of plant air is exhausted along with the excess steam. Frequently, this exhausted blant air has been either heated or air conditioned at a cost of, for example, five cents per 10,000 cubic feet. Accordingly, the monetary savings resulting from elimination of the air losses through an exhaust hood can be a multiple of four or five times the savings in steam costs. Other less dramatic but nevertheless important cost savings result from eliminating the capital expense of the steam hood and the power costs involved in operating a substantial (e.g., five horsepower) exhaust fan.

Thus, both the process advantages and the cost savings from the use of the process and apparatus of the invention are very dramatic.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. The method of treating knitted fabric, in which a continuous web of the fabric is laterally distended to predetermined width and then finish processed, which comprises (a) presenting the fabric in substantially dry condition and in generally flat form, (b) steaming the fabric by (i) guiding said fabric upwardly into, and then downwardly out of an open bottom steam chamber, and (ii) supplying said steam chamber with saturated steam substantially at atmospheric pressure, (c) immediately after steaming, spreading the steamed fabric to said predetermined width, and (d) immediately thereafter finish processing said fabric.

2. The method of claim 1, wherein (a) said fabric is tubular knitted fabric.

3. The method of claim 1, wherein (a) said finish processing comprises mechanically compressively shrinking said fabric in a lengthwise direction.

4. The method of claim 1, wherein (a) said finish processing comprises calendaring said fabric.

5. The method of claim 1, wherein (a) the temperature within said chamber is sensed at a point near the open bottom thereof, and (b) the supply of said saturated steam is controlled in accordance with the temperature sensed at said point, to maintain saturated steam in said chamber to a level near said point.

6. An apparatus for treating knitted fabric and of the type including means for spreading, steaming and finish processing the fabric, which comprises (a) supply means for supplying knitted fabric in substantially dry condition and in generally flat form, (b) a generally vertically oriented, open bottom housing forming a substantially closed steam chamber, (c) means for guiding fabric, received from said supply means, upwardly into said steam chamber and then downwardly out of said chamber, (d) means for supplying saturated steam at atmospheric pressure to the interior of said steam chamber to maintain upper portions of said chamber substantially filled with said saturated steam, (e) fabric spreading means positioned adjacent the open bottom of said steam chamber for receiving and laterally distending fabric exiting said chamber, and (f) finish processing means positioned to receive fabric from said spreading means.

7. An apparatus according to claim 6, wherein (a) said fabric is tubular knitted fabric, (b) said spreading means comprises an entry section for receiving fabric from said steam chamber and an exit section for discharging fabric to said finish processing means, and external drive means, intermediate said entry and exit sections, for positioning and driving said spreading means.

8. An apparatus according to claim 6, wherein (a) temperature sensing means are positioned in said steam chamber, at a short distance above said open bottom, for sensing an interface between steam and air, and (b) said means for supplying saturated steam includes valve means responsive to said temperature sensing means for supplying saturated steam as necessary to maintain said interface at a substantially constant level.

9. An apparatus according to claim 6, wherein (a) spaced apart first and second guide rollers are mounted adjacent and below said open bottom, (b) an upper guide roller is retractably positioned within said chamber, (c) controllable actuator means are provided for retracting said upper guide roller to a position below said open bottom to facilitate initial threading of a fabric web.

10. An apparatus according to claim 9, wherein (a) vertical guide means are mounted within said steam chamber, at opposite sides thereof, for guiding and supporting opposite ends of said upper guide roller when said roller is positioned within said chamber.

11. An apparatus according to claim 9, wherein (a) said upper guide roller is adjustably positioned in said steam chamber at controllable distances above said interface.

* * * * *